United States Patent [19]

Manyek

[11] 4,010,854

[45] Mar. 8, 1977

[54] UNCOUPLING LEVER ASSEMBLY

[75] Inventor: Leonard Francis Manyek, Lansing, Ill.

[73] Assignee: Stanray Corporation, Chicago, Ill.

[22] Filed: June 5, 1975

[21] Appl. No.: 583,870

[52] U.S. Cl. ..... 213/166; 213/219

[51] Int. Cl.[2] ..... B61G 3/08

[58] Field of Search ..... 213/166–170, 213/211, 219; 308/3 R, 3 A, 3.5, 237 R

[56] References Cited

UNITED STATES PATENTS

| | | | |
|---|---|---|---|
| 3,568,858 | 3/1971 | Manyek | 213/219 X |
| 3,586,273 | 6/1971 | Sloyan | 308/3 X |
| 3,885,837 | 5/1975 | Mellor | 308/3 R |

*Primary Examiner*—Robert B. Reeves
*Assistant Examiner*—John P. Shannon
*Attorney, Agent, or Firm*—Robert E. Wagner; Robert E. Browne

[57] ABSTRACT

A railroad car uncoupling lever assembly having a handle member, a lock lifter member, and means for connecting the two members and permitting their relative axial movement in response to lateral and longitudinal movements of the railroad coupler. The connecting means includes, in one embodiment, a plurality of guide sleeves formed of high lubricity plastic material snap fitted onto one of the members with a bearing face engageable with the other member to facilitate movement of the members and reduce wear. In a second embodiment the guide sleeves are mounted on opposite sides of a connecting member to permit extensive telescoping movement of the uncoupling assembly.

6 Claims, 10 Drawing Figures

UNCOUPLING LEVER ASSEMBLY

BACKGROUND OF THE INVENTION

This invention relates to uncoupling assemblies used in railroad cars having couplers which may move laterally and/or longitudinally, and, in particular, to a connecting means to facilitate movement of the assembly while reducing wear on its elements.

A variety of uncoupling lever or rod assemblies have been developed for uncoupling the couplers of railroad cars. The more basic of these assemblies include a single elongated rod having one end pivotally connected to the car and engaging the lock lifter of the car coupler with its other end. More sophisticated versions include telescoping coupler assemblies adapted for use with cars in which the coupler travels a considerable longitudinal distance relative to the endsill of the car. Versions used in standard draft cushioning also provide for some extension of the uncoupling rod assembly. Either of these latter versions usually involves relative axial movement of one or more parallel members. Examples of prior art coupling devices are shown in U.S. Pat. Nos. 3,232,444 to B. J. Halon, issued to the assignee of the present invention, and 3,834,554 to Chierici. Each of these patents teaches use of an uncoupling assembly including a handle member, a lock lifter member having one end formed to engage the particular type of coupler used, and a clip or slideway which may be mounted on one of the members to receive the opposite end of the other member to permit their relative axial but parallel movement.

Present uncoupling rod assemblies, however, still present significant problems which stem, primarily, from the friction created when uncoupling rods of the telescoping variety are attempted to be moved relative to one another in response to movements of the coupler. The metal to metal contact between the rods and/or the slideway or guide results in high frictional forces and resistance to movement. Dirt or foreign matter collects between the adjacent surfaces of the telescoping members and/or slideway, further preventing or hampering their movement. Finally, the constant frictional forces and stresses on the engaging parts in transit significantly increases wear and breakage.

SUMMARY OF THE INVENTION

The present invention provides a solution to the problems of wear, dirt and friction inherent in the available prior art. It overcomes these problems by use of a plurality of guide sleeves which may be mounted on the handle member, the lock lifter member, or, as will be explained below, on a connecting member for extended telescoping movement. These sleeves have, mounted within them, a bearing pad formed of a material diverse from that of the handle member and lock lifter member, which has an inherent high lubricity surface which engages the parallel relatively moving, lock lifter and handle members to facilitate their axial movement and greatly reduce wear and sticking of engaging parts of the uncoupler assembly.

The guide sleeves preferably include one or more generally rectangular, hollow C-shaped bearing sleeves which may be mounted near the free end of either the handle member or the lock lifter member in one embodiment. A bearing pad, which is preferably formed of a plastic material, such as a high molecular polyethylene, in a U-shape conforming to the dimension of the guide sleeve is mounted within each sleeve. In the preferred embodiment, the legs of the U-shaped bearing pad are pitched slightly outwardly so that the pad must be wedged within the guide sleeve. The natural resiliency of the material will cause the legs to spring outwardly against the interior walls of the sleeve to retain the pad in position. The pad also has exterior end flanges which engage the ends of the guide sleeves to prevent longitudinal movement of the pad relative to the sleeve. Alternatively, the pad and sleeve may also be formed with corresponding holes therein through which bolts may be inserted to firmly mount the pad within the sleeve.

The second embodiment of the uncoupling lever assembly shown herein is designed for use with sliding center sill underframes for traveling couplers which require a greater extension of the uncoupling assembly due to their longitudinal movement relative to the car frame. In this embodiment the handle member and lock lifter member are positively connected and maintained in generally parallel alignment by a center connecting member or bar which has, mounted on its opposite sides at its opposite ends, one or more of the guide sleeves described above having "snap in" bearing pads similar to those described above.

The bearing pads mounted within the guide sleeves support the moving members of the uncoupling assembly in bearing and totally engage the metal surfaces so that wear will occur on the surfaces of these pads. The hardness of the surfaces of the pads and their natural lubricity will significantly facilitate relative axial movement of the handle and lock lifter members and reduce wear of these members. The "snap in" bearing pads are easily replaceable in a matter of seconds to avoid any lengthy down time due to necessary repairs or replacement, as in the prior art. The high lubricity surface of the pads further resist clogging by a foreign matter, and, therefore, provide optimum movement in the extension of coupler assembly at all times.

Accordingly, it is an object of the present invention to provide an improved uncoupling lever assembly which reduces frictional forces, wear, and sticking.

It is another object of the present invention to provide an improved uncoupling lever assembly having a high lubricity wearing means to engage the members of such assembly in bearing to facilitate their relative movement and reduce wear.

It is a further object of the present invention to provide an uncoupling lever assembly having a handle member, a lock lifter member and a connecting means including guide members having a wearing means mounted therein for receiving opposite ends of said handle member and said lock lifter member to permit their relatively frictionless axial movement and reduce wear.

It is a further object to the present invention to provide an improved uncoupling lever assembly having a removable bearing pad for use in a guide means receiving ends of a handle member and a lock lifter member, which bearing pad may be snap fit into position to engage such members and facilitate their axial relative movement.

Further objects of the present invention will become apparent through consideration of the following description taken in conjunction with the drawings wherein.

Figure 1:
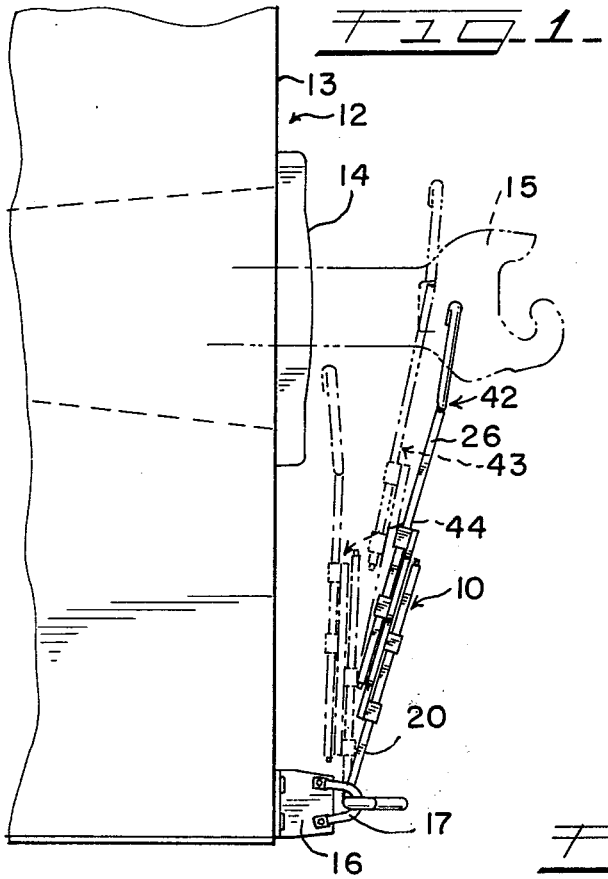
FIG. 1 is a fragmentary top plan view of an end of a railroad car underframe showing the uncoupling lever assembly of the present invention mounted thereon and also illustrating in hidden lines, possible positions of the lever assembly according to the movement of the coupler.
Figure 2:
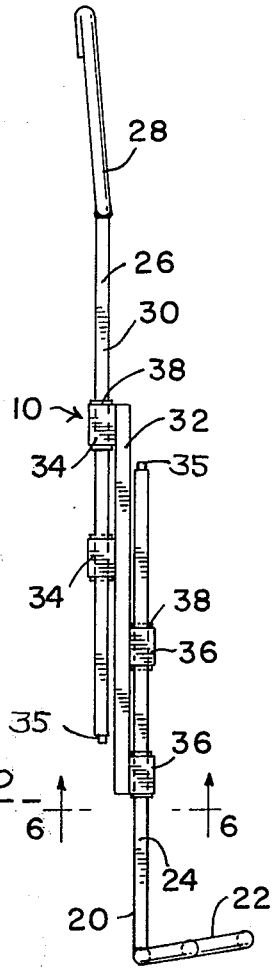
FIG. 2 is a top plan view of a first embodiment of the uncoupling lever assembly of the present invention.

Referring now to the drawings and, in particular, to FIG. 1, a first embodiment of the uncoupling lever assembly of the present invention is shown in general at 10. Uncoupling lever assembly 10 is pivotally mounted on an end of a frame 13 of a typical railroad car 12. Assembly 10 operates a coupler 15 (shown in hidden lines) which may be either the standard draft or travelling cushion variety.

The uncoupling lever assembly 10 includes a handle member 20, having a handle portion 22. The handle portion 22, may be any desired configuration but is generally shaped so that it has an eyelet 18 which may be inserted over a clevis 17 attached to a mounting bracket 16 fixed to the car frame 13. The handle member 20 is thereby pivotally supported by the bracket on the car 12. The construction of such mounting brackets is well known, and any suitable shaped bracket which allows the uncoupling lever assembly to be pivoted relative to the car while supporting the handle portion of the assembly is satisfactory. Handle portion 22 is welded or otherwise attached to a lever portion 24 to complete the handle member 20.

Figure 3:
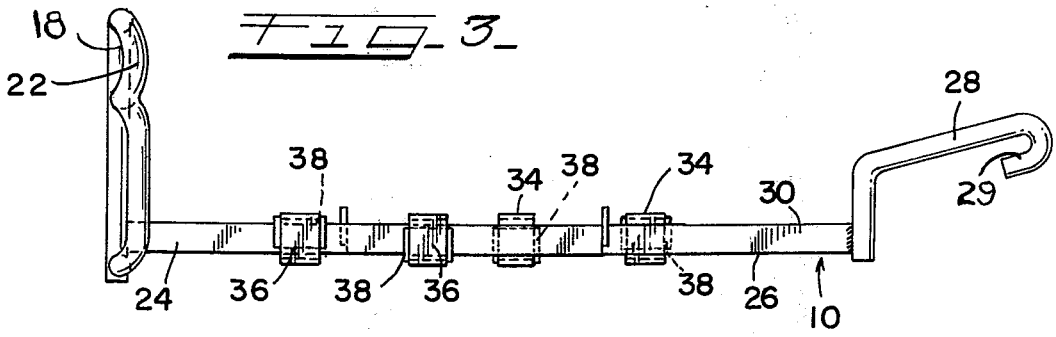
FIG. 3 is a front elevational view of the uncoupling lever assembly shown in FIG. 2.

Uncoupling lever assembly 10 also includes a lock lifter member 26 having a lock lifter portion 28 formed in a desired configuration to engage the lock lifter on a typical coupler 15. The lock lifter portion 28 is welded to a lever portion 30 to complete the lock lifter member. The configuration of the lock lifter portion 28 will be, of course, dictated by to the type of coupler it is to be used to operate. The hook 29 of the lock lifter portion 28, as shown in FIG. 3, is designed to hook into and operate the lock lifter of the car coupler 15 upon rotation of the lever portion 30 of the lock lifter member 26.

In both embodiments of the present invention shown in the drawings, the lever portion 24 of handle member 20, and the lever portion 30 of lock lifter member 26, are placed in adjacent, parallel relationship for axial movement relative to one another in a telescoping manner, according to the movement of the coupler 15, by a connecting means located intermediate the handle portion 22 and lock lifter portion 28 of each of these members, 20 and 26 respectively. In the embodiment of the present invention shown in FIGS. 1–3, 6 and 7, this connecting means includes an intermediate connecting lever 32, which is independent of both handle member 20 and lock lifter member 26, and is placed in axially parallel relationship adjacent and between each of these members. Connecting lever 32 is preferably formed from an elongated piece of bar stock which is generally rectangular in cross-section, as are the lever portions of handle member 20 and lock lifter member 26. On opposite sides of the connecting member 32 are placed a number of hollow guide sleeves 34 and 36. Guide sleeves 34 are inside guide sleeves, facing the front of the car 12, while guide sleeves 36 are outside guide sleeves, facing away from the car. Guide sleeves 34 and 36 are also generally rectangular in cross-section and may be quite short in length. While the configuration of the sleeves may be described as C-shaped, shown in FIG. 8, they nearly form a closed tube shape and are attached to the rectangular connecting lever 32 by welds 37. Inside guide sleeves 34 are mounted in spaced relationship along the inside surface of the connecting member 30 toward the coupler, while outside guide sleeves 36 are mounted on the opposite side of lever 32 toward the handle end thereof, which is also the outside of the car.

The lever portion 24 of handle member 20 is inserted through each of the outside guide sleeves 36 while the lever portion 30 of lock lifter member 26 is inserted through each of the inside guide sleeves 34. Stops 35, mounted at the interior ends of members 20 and 26 will engage the innermost of the guide sleeves 34 and 36 to stop movement of the members 20 and 26 relative to the sleeves and connecting member 32 and maintain the connection. In the above manner, the intermediate connecting member 32, containing guide sleeves 34 and 36, provides for axially telescoping movement on longitudinal movement of the coupler 15. Such movement is illustrated in FIG. 1 where the lever assembly 10 is shown in normal, centered position at 42, in inwardly telescoped position at 44, and in outwardly telescoped position at 43. As the uncoupler 15 moves angularly or linearly, the lock lifter member 26 will be moved until stopped adjacent an inward sleeve 34 and then, if necessary, will cause the connecting lever 32 to also move until the entire assembly 10 is sufficiently telescoped to reach the position of the coupler. The lever assembly 10 is also pivotable relative to the bracket 16 on handle portion 22, while being so extended by movement of the lock lifter member 26 and connecting lever 32 relative to the handle member 20, to uncouple the coupler 15. The handle portion 22 is rotated about the pivot point formed by clevis 17 in an upward fashion to impart a turning torque through levers 24 and 30 to enable the hook-shaped lock lifter portion 28, which engages the lock lifter of the coupler, to operate the lock lifter to uncouple the coupler.

The present invention also provides bearing means easily insertable into the interior of the hollow guide sleeves 34 and 36 which engage the lever portions 24 and 30 of the handle member and lock lifter member 20 and 26, respectively, to facilitate movement of the uncoupling lever assembly and reduce wear on parts which would otherwise have metal to metal bearing contact.

Figure 5:
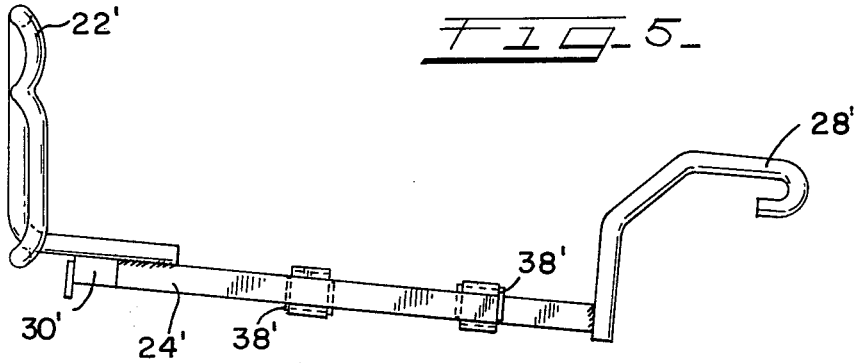
FIG. 5 is a front elevational view of the embodiment of the uncoupling lever assembly shown in FIG. 4.
Figure 6:
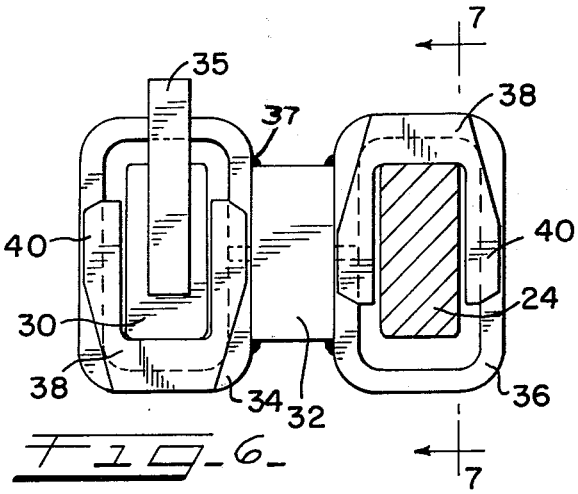
FIG. 6 is a cross-sectional view of the uncoupling lever assembly shown in FIG. 2, taken generally along line 6—6 thereof.
Figure 7:
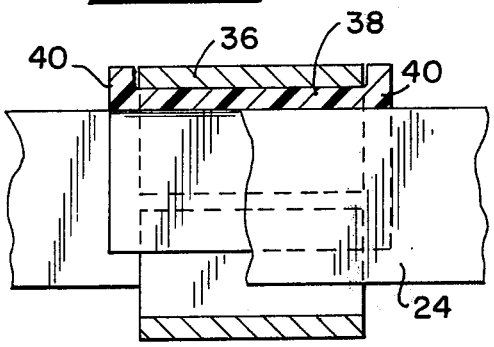
FIG. 7 is a cut-away and partial cross-sectional view of the cross-section of the uncoupling lever assembly shown in FIG. 6, taken generally along line 7—7 thereof.
Figure 8:
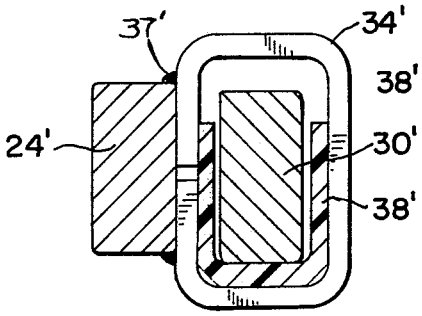
FIG. 8 is a cross-sectional view of the uncoupling lever assembly shown in FIG. 4, taken generally along line 8—8 thereof.
Figure 9:
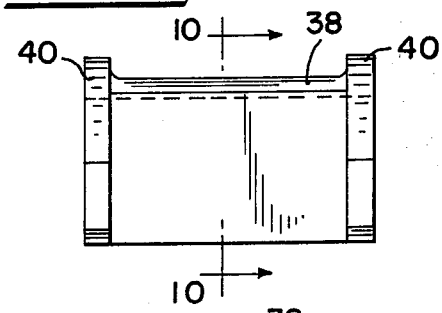
FIG. 9 is a front elevational view of the snap-in bearing pad of the uncoupling lever assembly of the present invention; and, FIG. 10 is a cross-sectional view of the bearing pad shown in FIG. 9, taken generally along line 10—10 thereof.
Figure 10:
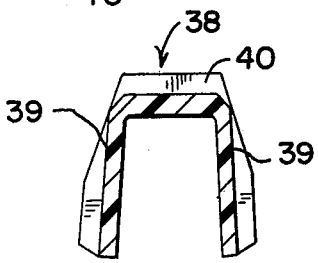

These bearing means are generally U-shaped bearing pads 38, as shown in FIGS. 9 and 10, which may be bolted into each of the guide sleeves 34 and 36, but which are preferably integrally formed of a diverse material from the handle member or lock lifter member to simply snap-fit into each guide sleeve in the position desired, as shown in FIGS. 5, 6, 7 and 8. Each bearing pad 38 is preferably formed of plastic material such as high molecular polyethylene, polytetrafluoroethylene, or carbon monofluoride or any other suitable resilient material having a surface formed of carbon monofluoride. Such material must have inherent high lubricity to substantially reduce friction as the various members move on it relative to one another, and surface hardness to reduce wear. Each bearing pad 38 is formed in a generally rectangular shape, corresponding to the member it will support in bearing, and a length approximately equal to the length of the guide sleeve into which it will be inserted. As shown in the drawings, it is not necessary that these bearing pads cover the entire interior surface of the hollow guide sleeves, as will be explained below. However, bearing pad 38 is purposely formed of the desired plastic material with generally vertical legs 39 having a slightly outward pitch, as shown in FIG. 10. Since such suitable plastic materials are slightly resilient, the legs 39 of the bearing pad 38 may be pinched inward to allow the pad to be inserted into and through each guide sleeve 34 or 36. The resilient memory of the material will then cause the pad legs to spring outward toward their original position causing the legs 39 to engage the interior side wall surfaces of each hollow sleeve, as shown in FIGS. 6 and 8, to thereby maintain the bearing pad in the desired position within the sleeve. Each bearing pad 38 is also formed with end flanges 40 formed at its opposite ends which act to engage the ends of the guide sleeves 34 and 36, as shown in FIG. 7, and thereby prevent longitudinal movement of the pad relative to the sleeve during operation of the lever assembly.

Figure 4:
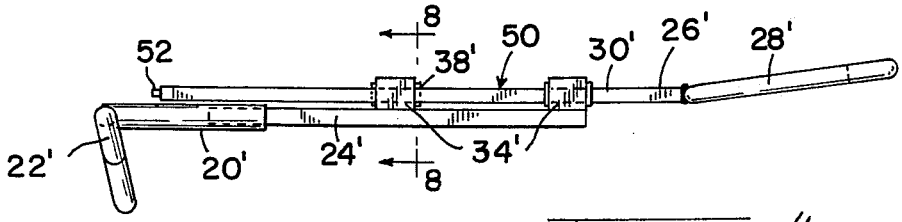
FIG. 4 is a top plan view of a second embodiment of the uncoupling lever assembly of the present invention.

FIG. 4 generally shows, at 50, a slightly modified embodiment of the lever assembly of the present invention in which the intermediate connecting lever 32 has been eliminated. Elements in this embodiment which are similar to those discussed above are illustrated by prime numerals. It can be seen that only two guide sleeves 34' are used, both of which are mounted on the interior side of lever portion 24' of handle member 20'. The lock lifter member 26' then has its lever portion 30' inserted through these guide sleeves and the operation of the lever assembly 50 occurs as described above. This embodiment 50, is useful in standard draft couplers where a great amount of telescoping is not required.

It is preferred that, in either embodiment, bearing pads be alternately placed within the guide sleeves, at top and bottom, as shown in FIGS. 3 and 6 to prevent metal to metal contact. Such alternate placement is necessitated since gravity will cause the members 20 and 26 to bear on the bottoms of each inward guide sleeve, while the turning torque and outward end support of each member will cause bearing forces on the upper interior faces of the outward guide sleeves. Therefore, the bearing pads 38 should be placed as shown in FIGS. 3 and 5 for proper bearing support preventing metal to metal contact. If additional guide sleeves are used, the exact positioning in the bearing pads required to prevent metal to metal engagement can be quickly determined for any type of coupler or connector by simple experimentation in the field. In addition, one or more bearing pads 38 can be easily adapted to fit within a single elongated guide sleeve rather than in a plurality of sleeves if such construction is desired.

It is readily apparent that the use of the snap-in bearing pads as shown in FIGS. 9 and 10 within guide sleeves mounted on either a connecting lever 32 or directly on the handle member 20', will result in the telescoping members being supported and moving entirely on a surface of a material diverse from their own material and which has an inherent high lubricity and wearability. Since the bearing pads of this invention snapfit into position, they are easily replaceable, reducing down time and replacement costs. The uncoupling lever assembly of the present invention and each of its elements is also easily replaceable in the field and is easy to construct and is reliable in operation.

While this invention has been described in relation to preferred embodiments thereof, it will be apparent to those skilled in the art that various modifications may be made without departing from the principles of the invention. Therefore, only such limitations should be imposed as are indicated by the spirit and scope of the appended claims.

I claim:

1. An uncoupling lever assembly particularly adapted for use on a railroad car having a coupler mounted at an end thereof for side to side lateral movement and movement longitudinally of the car in response to buff and draft forces, said coupler having a lock lifter for uncoupling the coupler, said assembly including a handle member having a handle portion at one end thereof, said handle member being pivotally mounted on said end of said car, a lock lifter member having a lock lifter portion near one end thereof, said lock lifter portion formed to engage said lock lifter for support by said coupler, connecting means disposed generally intermediate said handle portion of said handle member and said lock lifter portion of said lock lifter member to connect said handle member to said lock lifter member, near an opposite end of each, in adjacent, generally parallel relationship to allow their axial movement relative to one another while allowing turning torque to be transmitted from said handle member pivoted relative to said car to said lock lifter member to uncouple said coupler, said connecting means including guide means formed to maintain said opposite ends of each of said handle member and said lock lifter member in said parallel relationship, by limiting the vertical and lateral movement of said members, and bearing means, mounted within said guide means to be engaged by said handle member and said lock lifter member to facilitate relative axial movement of said members and to reduce wear, said bearing means including bearing pads formed from a resilient material in a generally U-shaped configuration, having a bottom surface and two side surfaces formed by generally vertical legs, said legs having a slightly outward pitch such that they may be snapped into said guide means to engage an interior side surface of said guide means with a sufficient force to maintain said bearing pad within said guide means during operation of said uncoupling lever assembly, each of said bearing pads being slightly longer in length than a corresponding one of said guide means and having outwardly extending flanges at opposite ends thereof, said flanges engaging exterior end surfaces of said guide means to prevent longitudinal movement of said bearing pad relative to said guide means.

2. The uncoupling assembly of claim 1 wherein said connecting means includes a elongated connecting lever member disposed parallel and adjacent to said opposite ends of said handle member and said lock lifter member, respectively, said connecting lever member having guide means mounted on opposing sides thereof, said guide means mounted on one side of said lever member receiving said opposite end of said handle member and said guide means mounted on an opposite side of said connecting lever member receiving said opposite end of said lock lifter member, to thereby maintain said handle member and said lock lifter member in adjacent, parallel relationship while allowing said members to telescope axially in response to the lateral and longitudinal movements of said coupler.

3. The uncoupling lever assembly of claim 2 wherein said guide means includes at least two generally rectangular hollow sleeves mounted in axially spaced relationship on each of said opposing sides of said connecting lever member near the opposite ends thereof, said sleeves receiving therethrough for movement therewithin said opposite ends of said handle member and said lock lifter member in axially parallel, adjacent relationship on said opposing sides of said connecting lever member while allowing said connecting lever member and said lock lifter member to move relative to said handle member and to one another in response to lateral and longitudinal movements of said coupler.

4. The uncoupling lever assembly of claim 1 wherein said guide means includes a plurality of rectangular hollow sleeves, said sleeves generally corresponding in configuration to the cross sectional configuration of said handle member and said lock lifter member, said sleeves being adapted to receive therein, for movement relative thereto, said opposite ends of said lock lifter member and said lock lifter member in adjacent, parallel relationship and to facilitate their relative movement in response to lateral and longitudinal movement of said coupler.

5. In an uncoupling lever assembly particularly adapted for use on a railroad car having a coupler mounted at the end thereof for movement laterally and longitudinally of the car in response to buff and draft forces, said coupler having a lock lifter for uncoupling the coupler, said assembly including a handle member having a handle portion at one end thereof, said handle member being pivotally mounted on said end of said car, a lock filter member having a lock lifter portion near one end thereof, said lock lifter portion formed to engage said lock lifter for support by said coupler, and connecting means disposed generally intermediately of said handle portion of said handle member and said lock lifter portion of said lock lifter member, near an opposite end of each to maintain said handle member and lock lifter member in generally adjacent, parallel relationship for axial movement relative to one another while allowing turning torque to be transmitted to said lock lifter member as said handle member is pivoted relative to said car to uncouple said coupler, said connecting means including hollow guide means receiving and maintaining said opposite ends of each said handle member and said lock lifter member in such generally parallel relationship, the improvement comprising bearing pads formed of plastic material having sufficient surface hardness to reduce wear and having an inherent high lubricity to reduce frictional forces and facilitate operation of the uncoupling lever assembly, each of said bearing pads being formed in a generally U-shaped configuration, having a bottom surface and two side surfaces formed by generally vertical legs, said legs having a slightly outward pitch, such that they may be snapped into said guide means to engage an interior side surface of said guide means during operation of said uncoupling lever assembly, each of said bearing pads being slightly longer in length than said guide means and having outwardly extending flanges at opposite ends thereof, said flanges engaging exterior end surfaces of said guide means to prevent longitudinal movement of said bearing pad relative to said guide means, said bearing pads facilitating relative axial movement of said handle member and said lock lifter member by reducing friction and reducing wear on said members and said guide means.

6. An uncoupling lever assembly particularly adapted for use on a railroad car having a coupler mounted at an end thereof for side to side lateral movement and movement longitudinally of the car in response to buff and draft forces, said coupler having a lock lifter for uncoupling the coupler, said assembly including a handle member having a handle portion at one end thereof, said handle member being pivotally mounted on said end of said car, a lock lifter member having a lock lifter portion near one end thereof, said lock lifter portion formed to engage said lock lifter for support by said coupler, connecting means disposed generally intermediate said handle portion of said handle member and said lock lifter portion of said lock lifter member to connect said handle member to said lock lifter member, near an opposite end of each, in adjacent, generally parallel relationship to allow their axial movement relative to one another while allowing turning torque to be transmitted from said handle member pivoted relative to said car to said lock lifter member to uncouple said coupler, said connecting means including a plurality of individual guide means formed to maintain said opposite ends of each of said handle member and said lock lifter member in said parallel relationship, by limiting the vertical and lateral movement of said members, and bearing means, mounted within said guide means to be engaged by said handle member and said lock lifter member to facilitate relative axial movement of said members and to reduce wear, said bearing means including bearing pads formed of a plastic material having a relatively hard surface and a high natural lubricity, said bearing pads having a general interior configuration corresponding to the exterior configuration of a selected one of said handle member and said lock lifter member which said bearing pads engage and support in bearing within said guide means, said guide means including generally rectangular hollow guide sleeves mounted in axially spaced relationship on the same side of said connecting means, and said bearing pads being generally U-shaped in configuration, having a bottom surface, and two side surfaces formed by generally vertical legs, said bearing pads being alternately disposed within said guide sleeves, such that said vertical legs of said bearing pads are oppositely directed, to provide proper bearing support on opposite interior surfaces of said guide sleeves.

* * * * *